US008442259B2

(12) United States Patent
Williamson

(10) Patent No.: US 8,442,259 B2
(45) Date of Patent: May 14, 2013

(54) SYSTEM FOR VIBRATION CONFINEMENT

(75) Inventor: Clayton Williamson, Moorpark, CA (US)

(73) Assignee: Beats Electronics, LLC, Santa Monica, CA (US)

( * ) Notice: Subject to any disclaimer, the term of this patent is extended or adjusted under 35 U.S.C. 154(b) by 398 days.

(21) Appl. No.: 12/794,508

(22) Filed: Jun. 4, 2010

(65) Prior Publication Data

US 2011/0299718 A1 Dec. 8, 2011

(51) Int. Cl.
*H04R 1/00* (2006.01)

(52) U.S. Cl.
USPC ..... 381/398; 381/423; 381/424; 381/432

(58) Field of Classification Search ..... 381/398, 381/423, 424, 430, 432; 181/164–166, 17
See application file for complete search history.

(56) References Cited

U.S. PATENT DOCUMENTS

| | | | | |
|---|---|---|---|---|
| 5,687,247 | A * | 11/1997 | Proni | 381/398 |
| 6,219,432 | B1 * | 4/2001 | Fryer et al. | 381/398 |
| 6,672,423 | B2 * | 1/2004 | Kato | 181/161 |
| 6,721,435 | B2 | 4/2004 | Babb et al. | |
| 6,819,773 | B2 * | 11/2004 | D'Hoogh | 381/396 |
| 6,863,153 | B1 * | 3/2005 | Hayakawa et al. | 181/173 |
| 7,433,485 | B1 * | 10/2008 | Diedrich et al. | 381/404 |
| 7,438,155 | B2 | 10/2008 | Stead et al. | |
| 7,570,780 | B2 * | 8/2009 | Baeten | 381/423 |
| 7,813,522 | B2 * | 10/2010 | Ohashi et al. | 381/430 |
| 8,204,269 | B2 * | 6/2012 | Sahyoun | 381/398 |
| 2001/0033673 | A1 | 10/2001 | Babb et al. | |
| 2003/0068064 | A1 | 4/2003 | Czerwinski | |
| 2003/0188919 | A1 * | 10/2003 | Suzuki et al. | 181/171 |
| 2003/0190051 | A1 | 10/2003 | Williamson | |
| 2004/0213431 | A1 | 10/2004 | Mello | |
| 2004/0240702 | A1 * | 12/2004 | Kaiwa et al. | 381/423 |
| 2005/0147272 | A1 | 7/2005 | Hyre et al. | |
| 2005/0226459 | A1 * | 10/2005 | Tomiyama et al. | 381/424 |
| 2005/0244029 | A1 * | 11/2005 | Takayama et al. | 381/398 |
| 2006/0018500 | A1 * | 1/2006 | Watanabe | 381/398 |
| 2006/0120554 | A1 * | 6/2006 | Watanabe | 381/398 |

(Continued)

FOREIGN PATENT DOCUMENTS

| | | |
|---|---|---|
| JP | 2005-260537 | 9/2005 |
| WO | WO2011153490 | 12/2012 |

OTHER PUBLICATIONS

Klasco; "A Look at Speaker Cones—A Tutorial"; Voice Coil: The Periodical for the Loudspeaker Industry; 2009; 4 pages.

(Continued)

*Primary Examiner* — David S. Warren
(74) *Attorney, Agent, or Firm* — Michael G. Kelber; Neal, Gerber & Eisenberg LLP

(57) ABSTRACT

Systems and apparatuses are provided for vibration confinement and stress management in a loudspeaker. In one embodiment, the loudspeaker comprises a diaphragm that extends from an inner diaphragm region (e.g., dome or cone-shaped) to an outer diaphragm region, wherein the outer diaphragm region bends at a defined angle (e.g., between about 45 degrees and about 135 degrees) relative to the inner diaphragm region. The loudspeaker also comprises a suspension member extending from an inner suspension region to an outer suspension region, the inner suspension region overlapping and attaching with the outer diaphragm region. The bend in the diaphragm isolates the inner diaphragm region from spurious vibrations in the suspension member.

19 Claims, 3 Drawing Sheets

U.S. PATENT DOCUMENTS

| | | | | |
|---|---|---|---|---|
| 2006/0120555 | A1* | 6/2006 | Watanabe | 381/398 |
| 2006/0147081 | A1* | 7/2006 | Mango et al. | 381/398 |
| 2006/0256996 | A1* | 11/2006 | Baeten | 381/395 |
| 2007/0071275 | A1* | 3/2007 | Matsuda et al. | 381/423 |
| 2007/0140519 | A1* | 6/2007 | Fukuyama et al. | 381/398 |
| 2007/0201718 | A1* | 8/2007 | Shimoe et al. | 381/396 |
| 2007/0223772 | A1* | 9/2007 | Kaiwa | 381/398 |
| 2008/0159583 | A1* | 7/2008 | Tanaka et al. | 381/398 |
| 2009/0080686 | A1* | 3/2009 | Funahashi | 381/398 |
| 2009/0226018 | A1* | 9/2009 | Nielsen et al. | 381/337 |
| 2009/0262971 | A1* | 10/2009 | Funahashi | 381/398 |
| 2010/0303278 | A1* | 12/2010 | Sahyoun | 381/398 |
| 2011/0019865 | A1* | 1/2011 | Onodera | 381/423 |
| 2011/0044490 | A1* | 2/2011 | Makino | 381/398 |
| 2011/0299718 | A1* | 12/2011 | Williamson | 381/423 |
| 2011/0317869 | A1* | 12/2011 | Fujitani et al. | 381/423 |
| 2012/0106776 | A1* | 5/2012 | Liu | 381/413 |
| 2012/0195457 | A1* | 8/2012 | Shin | 381/398 |

OTHER PUBLICATIONS

International Search Report and Written Opinion dated Feb. 9, 2012 for PCT Application No. PCT/US2011/039161.

Article 34 Amendment and Reply to International Written Opinion for PCT Application No. PCT/US2011/039161 dated May 4, 2012.

International Preliminary Report on Patentability for PCT Application No. PCT/US2011/039161 dated Dec. 4, 2012.

* cited by examiner

SYSTEM FOR VIBRATION CONFINEMENT

BACKGROUND

1. Field

The present disclosure relates generally to the field of loudspeakers, and more particularly to the confinement of vibrations associated with a loudspeaker driver.

2. Related Art

There are numerous types of audio transducers or drivers for loudspeakers. A functionality of the driver is as a traditional direct radiator, which may include, for example, a moving voice coil immersed in a static magnetic field, coupled to a rigid diaphragm and a suspension system.

A motor system of a loudspeaker may include a permanent magnet, surrounded by steel parts that direct and shape the magnetic field. The loudspeaker may also include a voice coil, which may be a conductive wire (e.g., copper clad aluminum), sometimes referred to as a voice coil wire, wrapped around a non-conductive bobbin, sometimes referred to as a voice coil former. The voice coil former can provide mechanical stability and a platform for transmitting the coil force to the diaphragm.

The diaphragm is typically rigid and lightweight to move the air accurately, with minimized "break up" modes or other misbehavior. Ideally, the diaphragm exhibits perfectly pistonic motion. The diaphragm, sometimes referred to as a dome due to its shape, may be formed from aluminum or similar materials, or composites thereof, that exhibit high stiffness, low mass, and high deformation, thereby allowing deep shapes to be formed.

The suspension system generally provides the restoring force and maintains the coil in the correct position. The suspension allows for controlled axial motion, while largely preventing lateral motion or tilting that could cause the coil to strike the motor components. The stiffness vs. deflection of the suspension is carefully designed to match the force vs. deflection characteristics of the voice coil and motor system. The suspension may comprise a member formed from a polyurethane foam material or the like, and may be compressed into shape by heat and pressure in a mold. However, numerous problems arise when the suspension member is attached to the diaphragm. For example, the attachment of a suspension member with the diaphragm may permit spurious vibrations from the suspension system to be transmitted across the surface of the diaphragm, resulting in distortion and inaccuracies in the frequency response.

One known approach involves separating the diaphragm from the suspension member, and thereby isolating the diaphragm from high frequency vibrations in the suspension system. However, the loudspeakers associated with such approaches and designs can be difficult to manufacture, resulting in loudspeakers that are fragile and lacking in durability and reliability. Accordingly, there remains a need for a loudspeaker technology that isolates the diaphragm from vibrations associated with the suspension system, while being easy to manufacture, robust, and reliable.

SUMMARY

The following presents a simplified summary in order to provide a basic understanding of some aspects of the disclosed aspects. This summary is not an extensive overview and is intended to neither identify key or critical elements nor delineate the scope of such aspects. Its purpose is to present some concepts of the described features in a simplified form as a prelude to the more detailed description that is presented later.

In accordance with one or more aspects and corresponding disclosure thereof, various aspects are described in connection with an improved loudspeaker design for vibration confinement and stress management. The techniques described herein make it possible to isolate an inner region of a diaphragm from vibrations associated with a suspension system, while providing a loudspeaker that is easy to manufacture and reliable. In one embodiment, there is provided a loudspeaker comprising a diaphragm that extends from an inner diaphragm region (e.g., concave or convex shaped dome) to an outer diaphragm region, wherein the outer diaphragm region bends at a defined angle (e.g., approximately 90 degrees) relative to the inner diaphragm region. The loudspeaker may further comprise a frame and a suspension member extending from an inner suspension region to an outer suspension region, wherein the inner suspension region overlaps and attaches with the outer diaphragm region, thereby forming a vibration confinement portion at the defined angle relative to the inner diaphragm region. The outer suspension region may attach to the frame. In one embodiment, the defined angle may be between about 45 degrees and about 135 degrees. In related aspects, orientation of the vibration confinement portion at the defined angle (e.g., orthogonal angle) isolates the inner diaphragm region from spurious bending waves or vibrations from the outer suspension region.

In related aspects, the frame may comprise a mounting ring, such as, for example, an annular flat surface, within a horizontal plane. The outer suspension region may attach to the mounting ring. A downward plane through the outer diaphragm region may intersect with the horizontal plane at a given angle, such as, for example, between about 15 degrees to about 60 degrees. In one particular example, the given angle may be approximately 45 degrees. Similarly, an upward plane through the inner suspension region may intersect with the horizontal plane at the same given angle, or similar angle.

In further related aspects, the loudspeaker may further comprise a voice coil former that is located below and provides structural support to the diaphragm. In yet further related aspects, the inner suspension region and/or the outer suspension region may comprise flange(s).

In yet further related aspects, the inner suspension region and the outer diaphragm region are attached at an interface with an adhesive. The orientation of the vibration confinement portion at the defined angle induces a shear load on the interface, thereby strengthening the interface.

In accordance with one or more aspects of the embodiments described herein, there is provided a loudspeaker comprising: (a) a diaphragm extending from an inner dome area to an outer annular area, wherein the outer annular area bends at a defined angle (e.g., between about 45 degrees and about 135 degrees) relative to the inner dome area; and (b) a voice coil former located below and providing structural support to the diaphragm, the voice coil former extending from a bottom edge to a top edge, the top edge interfacing with the diaphragm between the inner dome area and the outer annular area.

In related aspects, the loudspeaker may further comprise an annular suspension member that extends from an inner suspension region to an outer suspension region, wherein the inner suspension region overlaps and attaches with the outer annular area of the diaphragm.

In accordance with one or more aspects of the embodiments described herein, there is provided a loudspeaker comprising: (a) a frame having a mounting ring within a horizontal plane; (b) a diaphragm extending from an inner concave dome region to an outer annular region, wherein the outer annular region extends downwardly at a defined angle (e.g., approximately 45 degrees) relative to the horizontal plane; and (c) a suspension member extending from an inner suspension region to an outer suspension region, wherein the inner suspension region overlaps and attaches with the outer annular region of the diaphragm to form a vibration confinement portion oriented at the defined angle relative to the horizontal plane. Orientation of the vibration confinement portion at the defined angle isolates the inner concave dome region of the diaphragm from spurious bending waves from the outer suspension region. In one embodiment, the defined angle may be between about 15 degrees and about 60 degrees.

To the accomplishment of the foregoing and related ends, one or more aspects comprise the features hereinafter fully described and particularly pointed out in the claims. The following description and the annexed drawings set forth in detail certain illustrative aspects and are indicative of but a few of the various ways in which the principles of the aspects may be employed. Other advantages and novel features will become apparent from the following detailed description when considered in conjunction with the drawings and the disclosed aspects are intended to include all such aspects and their equivalents.

BRIEF DESCRIPTION OF THE DRAWING

The features, nature, and advantages of the present disclosure will become more apparent from the detailed description set forth below when taken in conjunction with the drawings in which like reference characters identify correspondingly throughout and wherein.

DETAILED DESCRIPTION

Various aspects are now described with reference to the drawings. In the following description, for purposes of explanation, numerous specific details are set forth in order to provide a thorough understanding of one or more aspects. It may be evident, however, that the various aspects may be practiced without these specific details.

Figure 1:
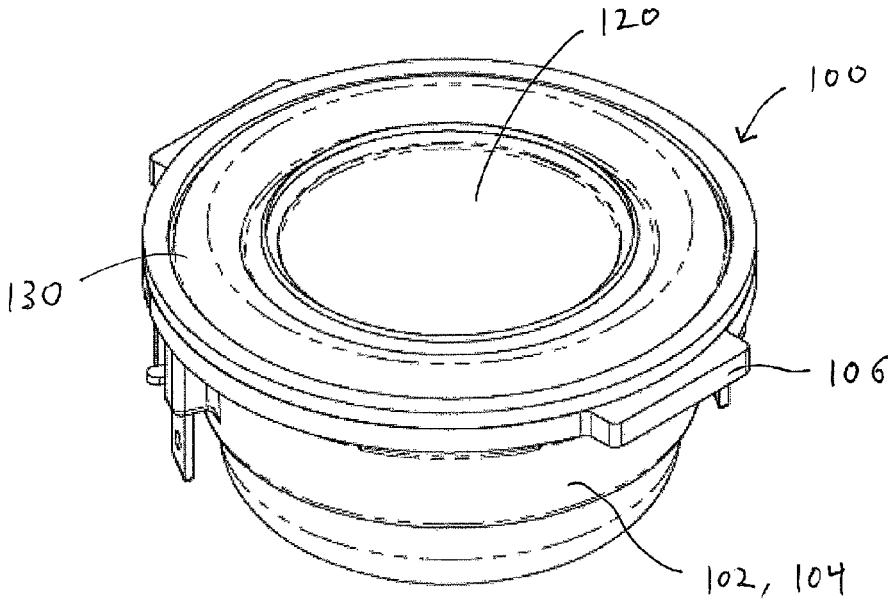
FIG. 1 provides an isometric view of an example loudspeaker.

With reference to FIG. 1, there is provided an isometric view of a loudspeaker 100. The loudspeaker 100 may include a frame 102 that includes a circular perimeter 104 and a mounting ring 106 (e.g., an annular flat surface). The loudspeaker 100 may include a dome or diaphragm 120 within the frame 102. The loudspeaker 100 may include a suspension or surround system 130 positioned above the frame 102.

Figure 2:
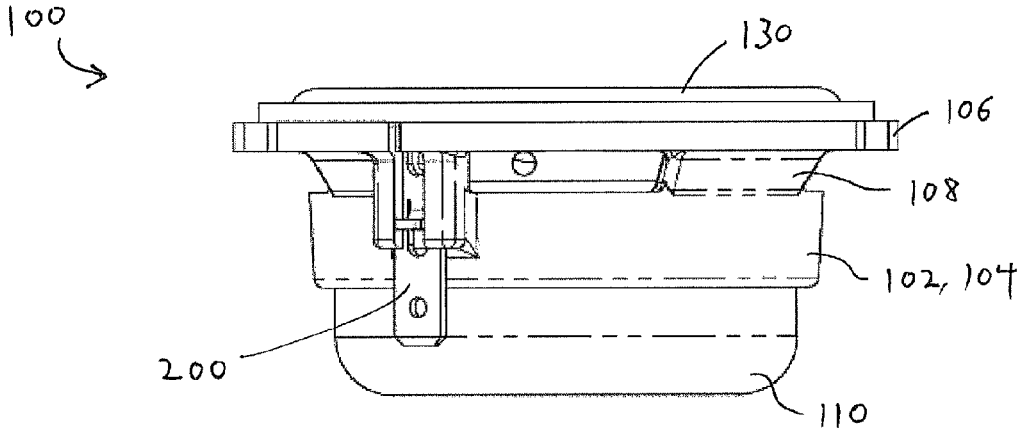
FIG. 2 provides a side view of the example loudspeaker shown in FIG. 1.

With reference to FIG. 2, there is provided a side view of the loudspeaker 100. The suspension system 130 extends upwardly from the mounting ring 106 of the frame 102. The frame 102 may further include a plurality of buttress blocks 108 and a pot 110, which may be a cup-shaped bottom portion of the frame 102. The buttress blocks 108 and/or the pot 110 may be formed of metal or similar material. A magnetic pole may be incorporated in the lower most portion of the pot 110. Also illustrated is a fastener 200 for securing the components of the frame 102 and/or other loudspeaker components together.

Figure 3:
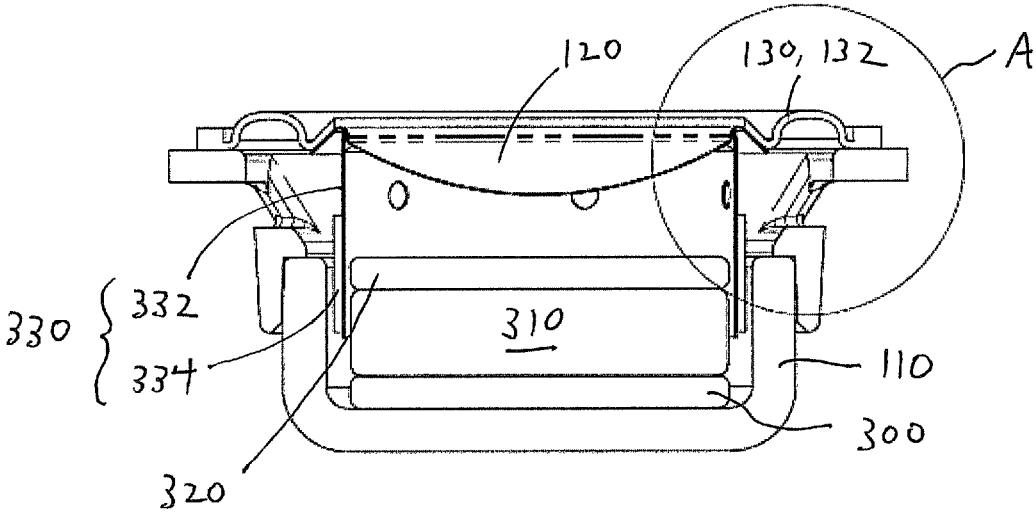
FIG. 3 is a cross-sectional view of the example loudspeaker shown in FIG. 2.

With reference to FIG. 3, there is provided a cross-sectional view of the loudspeaker 100. There is shown within the pot 110, a pedestal 300. Positioned above the pedestal 300 is a magnet 310, which may be a permanent magnet of any known material appropriate for utilization with loudspeakers. Positioned above the magnet 310 is a top plate 320, which is typically made from a magnetically soft iron or steel, or the like. Also shown is a voice coil 330, which may comprise a voice coil former 332 and a voice coil wire 334. The voice coil wire 334 may be wound around the voice coil former 332. It is noted that a wrapper or covering may be placed around the voice coil 330. It is further noted that other configurations of the frame 102, pedestal 300, magnet 310, and/or voice coil 330 may be utilized without departing from the scope of the embodiments described herein.

With continued reference to the embodiment of FIG. 3, the diaphragm 120 has a concave shape. However, the shown driver configuration can be used with a diaphragm of other shapes, such as, for example, a convex shape or the like. As noted previously, the diaphragm 120 may be made from any suitable material that provides rigidity, such as, for example, titanium, aluminum or other metal, or non-metal material (e.g., plastic, impregnated/reinforced paper, etc.).

Figure 4:
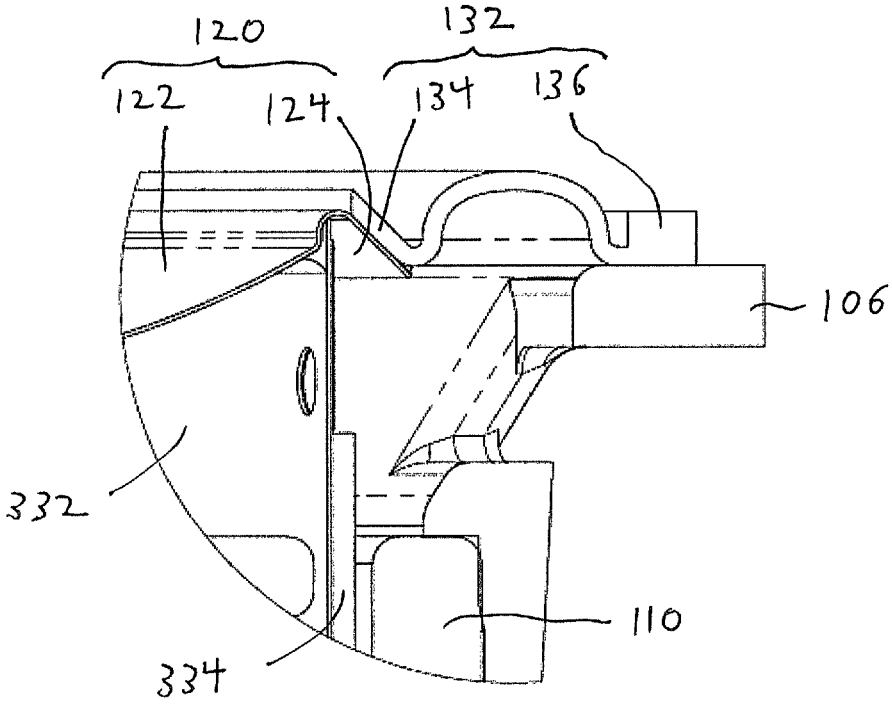
FIG. 4 is a close-up view of the encircled portion of the example loudspeaker shown in FIG. 3.

In accordance with one or more aspects of the embodiments described herein, there is provided an improved loudspeaker design for vibration confinement and stress management. With reference to the embodiment of FIG. 4, there is provided a close-up view of the encircled portion (circle A) of the example loudspeaker shown in FIG. 3. Specifically, there is shown in FIG. 4 the attachment of the diaphragm 120 to the suspension member 132 of the suspension system 130. The diaphragm 120 may extend from an inner diaphragm region 122, which may be, for example, dome-shaped or cone-shaped, to an outer diaphragm region 124, which may extend downwardly/upwardly and attach to the suspension member 132. In certain contexts, the inner diaphragm region 122 may also be referred to as a dome, a dome-shaped main body, an inner dome area, and a concave dome region.

Figure 5:
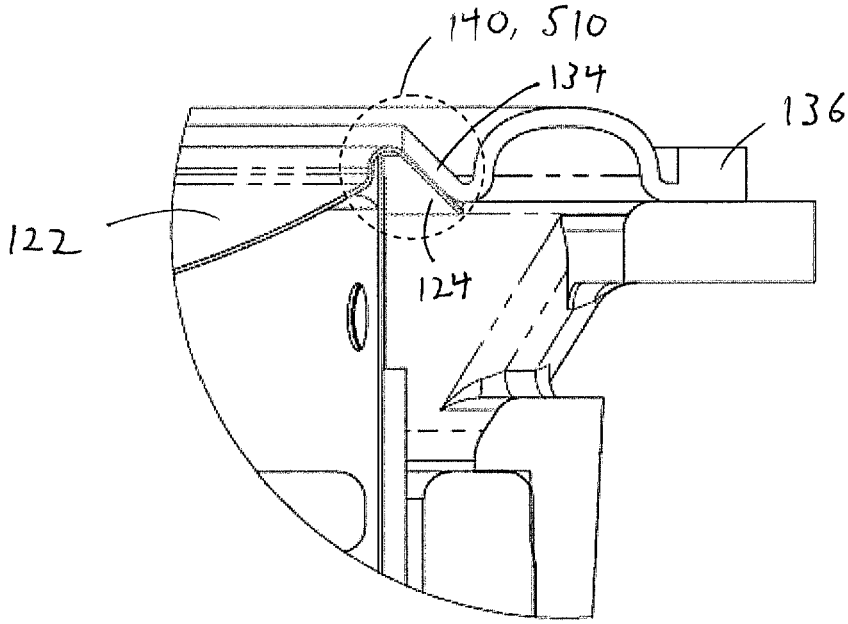
FIG. 5 is a detailed view of the encircled portion of the example loudspeaker shown in FIG. 3.

The suspension member 132 is preferably soft and flexible enough to allow free axial movement of the voice-coil-diaphragm assembly, and may extend from an inner suspension region 134 (which may include a lip) to an outer suspension region 136. The diaphragm 120 is preferably lightweight and stiff enough to remain pistonic over as wide a frequency range as possible. In the illustrated embodiment, the interface between the diaphragm 120 and the surround or suspension member 132 includes a roughly 45 degree bend in the shape of the diaphragm 120 relative to a horizontal plane, and is supported by the cylindrical voice coil former 332 from below. A roughly 90 degree bend of the outer diaphragm region 124 relative to the inner diaphragm region 122 can result in the roughly 45 degree bend in the diaphragm 120 relative to the horizontal plane. As a result, outer diaphragm region 124 and the inner suspension region 134 may overlap with and attach to each other, and together form an attachment region 140, as shown in FIG. 5. In the present example, both the outer diaphragm region 124 and the inner suspension region 134, as well as the resulting attachment region 140, are orthogonal relative to an upward plane through the inner diaphragm region 122 (i.e., orthogonal region intersects at roughly 90 degrees relative to the inner diaphragm region 122).

The combination of the extremely axially rigid former 332 and the orthogonal directions of the attachment region 140 versus the inner diaphragm region 122 mean that the unwanted vibrations of the suspension member 132 are effectively isolated from the inner diaphragm region 122 of the diaphragm 120. In other words, the non-pistonic vibrations are confined to the region outside the voice coil 330, leaving the inner diaphragm region 122 inside the voice coil 330 with purely pistonic motion.

With continued reference to FIGS. 4-5, the inner suspension region 134 may overlap and attach with the outer diaphragm region 124, thereby forming a vibration confinement portion 510. The outer suspension region 136 may be attached to the frame 102 (e.g., at the mounting ring 106) with an adhesive/glue or other known suitable technique. It is believed that, at the attachment region 140, angling a lip of the outer diaphragm region 124 downwards at a given angle (e.g., about 45 degrees relative to the horizontal plane), while angling a lip of the inner suspension region 134 of the suspension member 132 upwards (e.g., about 45 degrees relative to the horizontal lane) to align the shape of the lip with the direction of forces, reduces the peak stress in the suspension member 132 by more than a factor of five. This geometry provides the added benefit of reducing any peel type loads while inducing a primarily shear load on the material/adhesive interface, against which both the material and adhesive are quite robust, such that the joint is extremely resistant to crack propagation. It is noted that the material/adhesive interface is typically strong in shear, and that the above-described geometry of the angled lips in the attachment region 140 results in the load path occurring primarily in shear. In another embodiment (not shown), the lip of the outer diaphragm region 124 may be angled upwards, while angling the lip of the inner suspension region 134 downwards, to reduce the peak stresses, such as, for example, when the inner diaphragm region 122 comprises a convex shaped dome.

In related aspects, the loudspeaker 100 or loudspeaker driver may include a suspension member 132 extending from an inner suspension region 134 to an outer suspension region 136, the outer suspension region 136 attaching to the frame 102, the inner suspension region 134 overlapping and attaching with the outer diaphragm region 124 to form a vibration confinement portion 510 oriented at a defined angle relative to the inner diaphragm region 122. An orientation of the vibration confinement portion 510 at the defined angle isolates the inner diaphragm region 122 from spurious bending waves from the suspension member 132.

Figure 6:
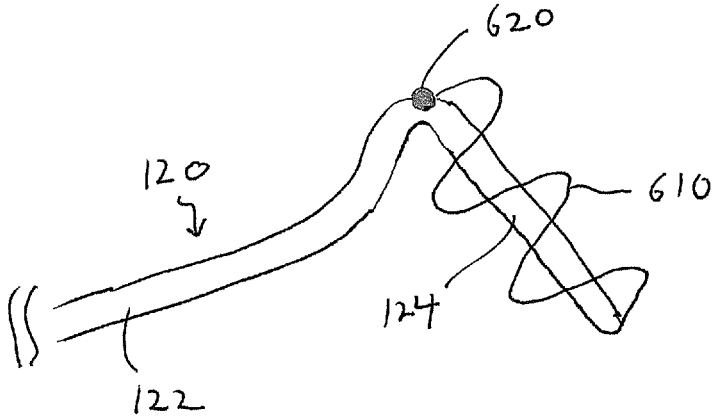
FIG. 6 is a detailed view of the encircled portion shown in FIG. 5.

With reference to FIG. 6, it is noted that the outer diaphragm region 124 may be susceptible to bending motions that are perpendicular to it, but is less susceptible to in-plane motions. The resultant bending motion of the surface of the material of the diaphragm 120 will look like a sinusoidal wave 610 superimposed on the outer diaphragm region 124. The motion at the end point 620 of the outer diaphragm region 124 (i.e., the end point 620 at or near the bend of the diaphragm) will be perpendicular to the surface of the outer diaphragm region 124. Similarly, the inner diaphragm region 122 is also very rigid in terms of in-plane motion, but flexible in terms of out-of-plane forces. As a result, when the forces at the inner diaphragm region 122 and the outer diaphragm region 124 are combined, the weak direction of motion of the outer diaphragm region 124 corresponds to the strong direction of motion of the inner diaphragm region 122, such that there is little or no component of the bending wave for the inner diaphragm region 122 transmitted by the outer diaphragm region 124.

Attaching the lip or the inner suspension region 134 to the diaphragm 120 in the manner described herein increases the robustness of the joint, as well as manufacturing tolerances, while reducing stresses otherwise associated with attaching a suspension member 132 directly to the diaphragm 120.

A challenge with loudspeaker devices is their sensitivity to stiffness variations, which can result in rocking modes where the coil will tilt and strike the motor. One major reason for these stiffness variations is a non-planar surround or non-planar attachment of the surround 132 to the coil 330. This technology described herein greatly reduces such stiffness variations or asymmetry by providing the very rigid and dimensionally stable metal support structure of the diaphragm 120 as the attachment structure for the surround 132. The resulting minimization of stiffness asymmetry, translates into higher yield rates and higher power handling and excursion for the loudspeaker 100.

In accordance with one or more aspects of the embodiments described herein, FIGS. 3-4, show an exemplary apparatus 100 (e.g., a loudspeaker or driver) that comprises a frame 102, as well as a diaphragm 120 extending from an inner diaphragm region 122 to an outer diaphragm region 124. The outer diaphragm region 124 may bend at a defined angle relative to the inner diaphragm region 122. The apparatus may also comprise a suspension member 132 extending from an inner suspension region 134 to an outer suspension region 136. The inner suspension region 134 may overlap and attach with the outer diaphragm region 124, and the outer suspension region 136 may attach to the frame 102. In one embodiment, the defined angle may be between about 45 degrees and about 135 degrees. For example, the defined angle may be approximately 90 degrees.

In related aspects, the frame 102 may comprise a mounting ring 106 within a horizontal plane, and the outer suspension region 136 may attach to the mounting ring 106. A downward plane through the outer diaphragm region 124 may intersect with the horizontal plane of the mounting ring 106 at a given angle (e.g., between about 15 degrees to about 60 degrees). For example, the given angle may be approximately 45 degrees. Similarly, an upward plane through the inner suspension region 134 may intersect with the horizontal plane at the given angle, such as, for example, between about 10 degrees to about 70 degrees (e.g., approximately 45 degrees as shown in the embodiment of FIG. 4).

In further related aspects, a voice coil 330 may be located below and provide structural support to the diaphragm 120. In yet further related aspects, the inner suspension region 134 and/or the outer suspension region 136 may comprise flange(s). In still further related aspects, the inner diaphragm region 122 may comprise a concave shaped dome or variations thereof. In another embodiment (not shown), the inner diaphragm region 122 may comprise a convex shaped dome or variations thereof. It will be noted that the diaphragm 120 may comprise any suitable shape, configuration, or dimensions, depending on the particular application or loudspeaker design.

In accordance with one or more aspects of the embodiments described herein, with continued reference to FIGS. 3-4, the apparatus 100 may comprise a diaphragm 120 extending from an inner diaphragm region 122 (e.g., an inner dome area) to an outer diaphragm 124 (e.g., outer annular area). The outer diaphragm region 124 may bend at a defined angle relative to the inner diaphragm region 122. The apparatus 100 may further comprise a voice coil 330 located below and providing structural support to the diaphragm 120, the voice coil 330 extending from a bottom edge to a top edge, the top edge interfacing with the diaphragm 120 between the inner diaphragm region 122 and the outer diaphragm region 124. In one embodiment, the defined angle may be between about 45 degrees and about 135 degrees (e.g., approximately 90 degrees).

In related aspects, the apparatus 100 may further comprise an annular suspension member 132 extending from an inner suspension region 134 to an outer suspension region 136, the inner suspension region 134 overlapping and attaching with the outer diaphragm region 124 of the diaphragm 120. In further related aspects, the inner suspension region 134 and/or the outer suspension region 136 may comprise flange(s). In the present example, the inner diaphragm region 122 comprises a concave dome. However, it will be understood that the inner diaphragm region 122 may comprise any suitable shape (e.g., a convex dome, conical shape, etc.), configuration, or dimensions, depending on the particular application.

In accordance with one or more aspects of the embodiments described herein, with continued reference to FIGS. 3-4, the apparatus 100 may comprise a frame 102 having an annular flat surface 106 within a horizontal plane, as well as a diaphragm 120 extending from an inner diaphragm region 122 (e.g., an inner concave dome region) to an outer diaphragm region 124 (e.g., an outer annular region), wherein the outer diaphragm region 124 may bend (e.g., extend downwardly or upwardly) at a defined angle (e.g., between about 15 degrees and about 60 degrees) relative to the horizontal plane. The apparatus 100 may further comprise a suspension member 132 extending from an inner suspension region 134 to an outer suspension region 136, wherein the inner suspension region 134 may overlap and attach with the outer diaphragm region 124, and wherein the outer suspension region 136 may attach to the annular flat surface 106 of the frame 102. In related aspects, the apparatus 100 further may comprise an upwardly extending voice coil former 332 that provides structural support to the diaphragm 120.

In the example of FIGS. 3-4, the defined angle is approximately 45 degrees; however, it will be understood that the outer diaphragm region 124 of the diaphragm 120 may bend at other suitable angles. Similarly, the inner suspension region 134 may extend upwardly at the same or similar angle as compared to the defined angle of the bend in the diaphragm 120.

While the present invention has been illustrated and described with particularity in terms of preferred embodiments, it should be understood that no limitation of the scope of the invention is intended thereby. Features of any of the foregoing methods and devices may be substituted or added into the others, as will be apparent to those of skill in the art. It should also be understood that variations of the particular embodiments described herein incorporating the principles of the present invention will occur to those of ordinary skill in the art and yet be within the scope of the invention.

What is claimed:

1. A loudspeaker, comprising:

a diaphragm extending from an inner diaphragm region to an outer diaphragm region, the outer diaphragm region bending at a defined angle relative to the inner diaphragm region;

a frame;

a voice coil former located below and providing structural support to the diaphragm, a top edge of the voice coil former interfacing with the diaphragm between the inner diaphragm region and the outer diaphragm region, whereby the inner diaphragm region is located inside the voice coil former and the outer diaphragm region is located outside the voice coil former; and a suspension member extending from an inner suspension region to an outer suspension region, the outer suspension region attaching to the frame, the inner suspension region overlapping and attaching with the outer diaphragm region to form a vibration confinement portion oriented at the defined angle relative to the inner diaphragm region;

wherein an orientation of the vibration confinement portion at the defined angle isolates the inner diaphragm region from spurious bending waves from the outer suspension region.

2. The loudspeaker of claim 1, wherein:

the inner suspension region and the outer diaphragm region are attached at an interface with an adhesive; and the orientation of the vibration confinement portion at the defined angle induces a primarily shear load on the interface, thereby strengthening the interface.

3. The loudspeaker of claim 1, wherein the defined angle is approximately 90 degrees.

4. The loudspeaker of claim 1, wherein:

the frame comprises a mounting ring within a horizontal plane; and the outer suspension region attaching to the mounting ring.

5. The loudspeaker of claim 4, wherein a downward plane through the outer diaphragm region intersects with the horizontal plane at approximately 45 degrees.

6. The loudspeaker of claim 5, wherein an upward plane through the inner suspension region intersects with the horizontal plane at approximately 45 degrees.

7. The loudspeaker of claim 1, wherein at least one of the inner suspension region and the outer suspension region comprises a flange.

8. The loudspeaker of claim 1, wherein the inner diaphragm region comprises one of a concave shaped dome and a convex shaped dome.

9. The loudspeaker of claim 1, wherein the inner dome area of the diaphragm comprises a cone-shape.

10. A loudspeaker, comprising:

a diaphragm extending from an inner dome area to an outer annular area, the outer annular area bending at a defined angle relative to the inner dome area;

a voice coil former located below and providing structural support to the diaphragm, the voice coil former extending from a bottom edge to a top edge, the top edge interfacing with the diaphragm between the inner dome area and the outer annular area, whereby the inner dome area is located inside the voice coil former and the outer annular area is located outside the voice coil former; and a suspension member extending from an inner suspension region to an outer suspension region, the inner suspension region overlapping and attaching with the outer annular area to form a vibration confinement portion oriented at the defined angle relative to the inner dome area;

wherein an orientation of the vibration confinement portion at the defined angle isolates the inner dome area from spurious bending waves from the outer suspension region.

11. The loudspeaker of claim 10, wherein:

the inner suspension region and the outer annular area are attached at an interface with an adhesive; and the orientation of the vibration confinement portion at the defined angle induces a shear load on the interface, thereby strengthening the interface.

12. The loudspeaker of claim 10, wherein the defined angle is approximately 90 degrees.

13. The loudspeaker of claim 10, wherein at least one of the inner suspension region and the outer suspension region comprises a flange.

14. The loudspeaker of claim 10, wherein the inner dome area of the diaphragm comprises one of a concave shaped dome and a convex shaped dome.

15. The loudspeaker of claim 10, wherein the inner dome area of the diaphragm comprises a cone-shape.

16. A loudspeaker, comprising:

a frame having a mounting ring within a horizontal plane;

a diaphragm extending from an inner concave dome region inside a voice coil former to an outer annular region outside the voice coil former, the outer annular region extending downwardly at a defined angle relative to the horizontal plane; and a suspension member extending from an inner suspension region to an outer suspension region, the outer suspension region attaching to the mounting ring of the frame, the inner suspension region overlapping and attaching with the outer annular region of the diaphragm to form a vibration confinement portion oriented at the defined angle relative to the horizontal plane;

wherein an orientation of the vibration confinement portion at the defined angle isolates the inner concave dome region of the diaphragm from spurious bending waves from the outer suspension region.

17. The loudspeaker of claim 16, wherein:

the inner suspension region and the outer annular area are attached at an interface with an adhesive; and the orientation of the vibration confinement portion at the defined angle induces a shear load on the interface, thereby strengthening the interface.

18. The loudspeaker of claim 16, wherein the defined angle is approximately 45 degrees.

19. The loudspeaker of claim 16, further comprising a voice coil former that provides structural support to the diaphragm.

* * * * *